US006105390A

United States Patent [19]

Bingham et al.

[11] Patent Number: 6,105,390

[45] Date of Patent: Aug. 22, 2000

[54] APPARATUS AND PROCESS FOR THE REFRIGERATION, LIQUEFACTION AND SEPARATION OF GASES WITH VARYING LEVELS OF PURITY

[75] Inventors: Dennis N. Bingham; Bruce M. Wilding; Michael G. McKellar, all of Idaho Falls, Id.

[73] Assignee: Bechtel BWXT Idaho, LLC, Idaho Falls, Id.

[21] Appl. No.: 09/212,490

[22] Filed: Dec. 16, 1998

Related U.S. Application Data

[60] Provisional application No. 60/069,698, Dec. 16, 1997.

[51] Int. Cl.[7] ..... F25J 1/00

[52] U.S. Cl. ..... 62/613; 62/619; 62/621; 62/910

[58] Field of Search ..... 62/611, 613, 619, 62/621, 87, 910, 5

[56] References Cited

U.S. PATENT DOCUMENTS

| | | | |
|---|---|---|---|
| 2,494,120 | 1/1950 | Ferro, Jr. | 62/87 |
| 3,292,380 | 12/1966 | Bucklin | 62/621 |
| 3,323,315 | 6/1967 | Carr | 62/613 |
| 3,362,173 | 1/1968 | Kniel | 62/9 |
| 3,416,324 | 12/1968 | Swearingen | 62/619 |
| 3,548,606 | 12/1970 | Kuertson | 62/9 |
| 3,596,473 | 8/1971 | Streich | 62/28 |
| 3,628,340 | 12/1971 | Meisler | 62/618 |
| 3,724,226 | 4/1973 | Pachaly | 62/39 |
| 4,128,410 | 12/1978 | Bacon | 62/40 |
| 4,334,902 | 6/1982 | Paradowski | 62/9 |
| 4,453,956 | 6/1984 | Fabbri et al. | 62/18 |
| 4,609,390 | 9/1986 | Wilson | 62/21 |
| 4,645,522 | 2/1987 | Dobrotwir | 62/18 |
| 4,846,862 | 7/1989 | Cook | 62/9 |
| 4,970,867 | 11/1990 | Herron et al. | 62/11 |
| 5,327,730 | 7/1994 | Myers et al. | 62/9 |
| 5,375,422 | 12/1994 | Butts | 62/24 |
| 5,390,499 | 2/1995 | Rhoades et al. | 62/9 |
| 5,450,728 | 9/1995 | Vora et al. | 62/23 |
| 5,537,827 | 7/1996 | Low et al. | 62/613 |
| 5,600,969 | 2/1997 | Low | 62/622 |
| 5,615,561 | 4/1997 | Houshmand et al. | 62/611 |
| 5,655,388 | 8/1997 | Bonaquist et al. | 62/651 |
| 5,669,234 | 9/1997 | Houser et al. | 62/612 |
| 5,718,126 | 2/1998 | Capron et al. | 62/613 |
| 5,755,114 | 5/1998 | Foglietta | 62/618 |
| 5,836,173 | 11/1998 | Lynch et al. | 62/613 |

*Primary Examiner*—Ronald Capossela
*Attorney, Agent, or Firm*—Workman Nydegger & Seeley

[57] ABSTRACT

A process for the separation and liquefaction of component gasses from a pressurized mix gas stream is disclosed. The process involves cooling the pressurized mixed gas stream in a heat exchanger so as to condense one or more of the gas components having the highest condensation point; separating the condensed components from the remaining mixed gas stream in a gas-liquid separator; cooling the separated condensed component stream by passing it through an expander; and passing the cooled component stream back through the heat exchanger such that the cooled component stream functions as the refrigerant for the heat exchanger. The cycle is then repeated for the remaining mixed gas stream so as to draw off the next component gas and further cool the remaining mixed gas stream. The process continues until all of the component gases are separated from the desired gas stream. The final gas stream is then passed through a final heat exchanger and expander. The expander decreases the pressure on the gas stream, thereby cooling the stream and causing a portion of the gas stream to liquify within a tank. The portion of the gas which is not liquefied is passed back through each of the heat exchanges where it functions as a refrigerant.

30 Claims, 10 Drawing Sheets

APPARATUS AND PROCESS FOR THE REFRIGERATION, LIQUEFACTION AND SEPARATION OF GASES WITH VARYING LEVELS OF PURITY

RELATED APPLICATION

This application claims priority from provisional application Ser. No. 60/069,698 filed Dec. 16, 1997. For purposes of disclosure this provisional application is incorporated by reference.

CONTRACTUAL ORIGIN OF THE INVENTION

The United States has rights in this invention pursuant to Contract No. DE-AC07-94ID13223 between the U.S. Department of Energy and Lockheed Martin Idaho Technologies Company.

BACKGROUND OF THE INVENTION

1. Field of the Invention

The present invention relates to methods and apparatus for separating, cooling and liquefying component gases from each other in a pressurized mixed gas stream. More particularly, the invention is directed to separation techniques that utilizes some of the components of the mixed gas stream that have already been separated to cool portions of the mixed gas stream that subsequently pass through the apparatus.

2. Description of the Prior Art

Individual purified gases, such as oxygen, nitrogen, helium, propane, butane, methane, and many other hydrocarbon gases, are used extensively throughout many different industries. Such gases, however, are typically not naturally found in their isolated or purified state. Rather, each individual gas must be separated or removed from mixtures of gases. For example, purified oxygen is typically obtained from the surrounding air which also includes nitrogen, carbon dioxide and many other trace elements. Similarly, hydrocarbon gases such as ethane, butane, propane, and methane are separated from natural gas which is produced from gas wells, landfills, city sewage digesters, coal mines etc.

In addition to separating or purifying the individual gases, it is often necessary to liquify gases. For example, liquified natural gas (LNG), which is primarily methane, is used extensively as an alternative fuel for operating automobiles and other machinery. The natural gas must be liquified or compressed since storing natural gas in an uncompressed vapor or gas state would require a storage tank of unreasonably immense proportions. Condensing or liquefying other gases is also desirable for more convenient storage and/or transportation.

The liquefaction of gases can be accomplished in a variety of different ways. The fundamental method is to compress the gas and then cool the compressed gas by passing it through a number of consecutively colder heat exchangers. A heat exchanger is simply an apparatus or process wherein the gas or fluid to be cooled is exposed to a colder environment which draws heat or energy from the gas or fluid, thereby cooling the gas. Once a gas reaches a sufficiently low temperature for a set pressure, the gas converts to a liquid.

The cold environment needed for each heat exchanger is generally produced by an independent refrigeration cycle. A refrigeration cycle, such as that used on a conventional refrigerator, utilizes a closed loop circuit having a compressor and an expansion valve. Flowing within the closed loop is a refrigerant such as Freon®. Initially, the refrigerant is compressed by the compressor which increases the temperature of the refrigerant. The compressed gas is then cooled. This is often accomplished by passing the gas through air or water cooled coils. As the compressed gas cools, it changes to a liquid. Next, the liquid passes through an expander valve which reduces the pressure on the liquid. This pressure drop produces an expansion of the liquid which may vaporize at least a portion thereof and which also significantly cools the now combined liquid and gas stream.

This cooled refrigerant stream now flows into the heat exchanger where it is exposed to the main gas stream desired to be cooled. In this environment, the refrigerant stream draws heat from the main stream, thereby simultaneously cooling the main stream and warming the refrigerant stream. As a result of the refrigerant being warmed, the remaining liquid is vaporized to a gas. This gas then returns to the compressor where the process is repeated.

By passing the main gas stream through consecutive heat exchangers having lower and lower temperatures, the main stream can eventually be cooled to a sufficiently low temperature that it converts to a liquid. The liquid is then stored in a pressurized tank.

Although the above process has been useful in obtaining liquefied gasses, it has several shortcomings. For example, as a result of the process using several discrete refrigeration cycles, each with its own compressor, the system is expensive to build, costly to run and maintain, and has an overall high complexity. A significant cost for any closed loop refrigeration system is the purchase and operation of the compressor. Not only does the compressor represent the process' largest capital expenditure, it also represents a major problem in the process system's flexibility. Once a compressor size is chosen, the process can only handle mass flow rates capable of being adequately compressed by the chosen compressor. In order to have wide flexibility in process flows, multiple compressors are then needed. These additional compressors also add to the cost and risk of equipment failure.

To make conventional systems cost effective to operate, such systems are typically built on a large scale. As a result, fewer facilities are built making it harder to get gas to the facility and to distribute liquefied gas from the facility. By their very nature, large facilities are required to store large quantities of liquified gas prior to transport. Storage of LNG can be problematic in that once the LNG begins to warm from the surrounding environment, the LNG begins to vaporize within the storage tank. To prevent pressure failure of the tank, some of the pressurized gas is permitted to vent. Such venting is not only an environmental concern but is also a waste of gas.

The steps for purification or separation of the different gases from a main mixed gas are often accomplished prior to the liquefaction process and can significantly add to the expense and complexity of the process. As a result, many productive gas wells having high concentrations of undesired gases or elements are often capped rather than processed.

OBJECTS AND BRIEF SUMMARY OF THE INVENTION

Accordingly, it is an object of the present invention to provide gas processing systems which can liquify at least a portion of a mixed gas stream.

Another object of the present invention is to provide gas processing systems which simultaneously purify the liquefied gas by separating off the other mixed gases.

It is also an object of the present invention to provide the above systems that can separate off each component gas of the mixed gas in a substantially pure form for subsequent use of each of the individual gases.

Yet another object of the present invention is to provide the above system which can be operated without the required use of independently operated compressors or refrigeration systems.

Still another object of the present invention is to provide the above systems which can be effectively produced to achieve any desired flow capacity and, furthermore, can be manufactured as small mobile units that can be operated at any desired location.

To achieve the forgoing objectives, and in accordance with the invention as disclosed and broadly claimed herein, a gas processing system and method of operation is provided for separating and cooling components of a pressurized mixed gas stream for subsequent liquefaction of a final or remaining gas stream. This inventive system and process comprises passing a pressurized mixed gas stream through a series of repeated cycles until a final substantially purified gas stream for liquefying is achieved. Each cycle comprises: (1) cooling the pressurized mixed gas stream in a heat exchanger so as to condense one or more of the gas components having the highest condensation point; (2) separating the condensed components from the remaining mixed gas stream in a gas-liquid separator; (3) cooling the separated condensed component stream by passing it through an expander; and then (4) passing the cooled component stream back through the heat exchanger such that the cooled component streams function as the refrigerant for the heat exchanger. The component stream then exits the system for use depending on the type and temperature of gas.

The above cycle is then repeated for the remaining mixed gas stream so as to draw off the next component gas and further cool the remaining mixed gas stream. The process continues until all of the unwanted component gases are removed. The final gas stream, which in the case of natural gas will be substantially methane, is then passed through a final heat exchanger. The final cooled gas stream is then passed through an expander which decreases the pressure on the gas stream. As the pressure decreases, the stream is cooled causing a portion of the gas stream to liquify within a tank. The portion of the gas which is not liquified is passed back through each of the heat exchangers where it functions as a refrigerant.

Where the initial pressure of the mixed gas stream is sufficiently high, the inventive systems can be operated solely from the energy produced by dropping the pressure. As such, there is no need for independently powered compressors or refrigeration cycles. In one embodiment, however, the final expander can comprise a turbo expander which runs a turbine as the gas is expanded therethrough. The electrical or mechanical energy from the turbine can be used to input energy into the system at any desired location. For example, the turbo expander can run a compressor which is used to increase the pressure of the initial gas stream. Where there is insufficient pressure in the initial gas stream, which cannot be sufficiently increased by the turbo expander, the present invention also envisions that an independently operated compressor can be incorporated into the system.

The inventive system has a variety of benefits over conventional systems. For example, by not needing independently operated compressors or refrigeration systems, the inventive system is simpler and less expensive. Furthermore, the inventive system can be effectively constructed to fit any desired flow parameters at virtually any location. For example, one unique embodiment of the present invention is to incorporate the inventive system onto a movable platform such as a trailer. The movable unit can then be positioned at locations such as a well head, factory, refueling station, or distribution facility.

An additional benefit of the present invention is that the system and process can be used to separate off purified component gas streams while simultaneously purifying the final gas stream. For example, during the production of LNG, the system can be designed, depending on the gas composition, to condense off substantially pure propane, butane, ethane, and any other gases present for subsequent independent use in their corresponding markets. By removing all the component gases, the final methane gas is also substantially purified. Accordingly, the inventive system and process can also be used to effectively operate gas wells that have historically been capped for having too high of a concentration of undesired components.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
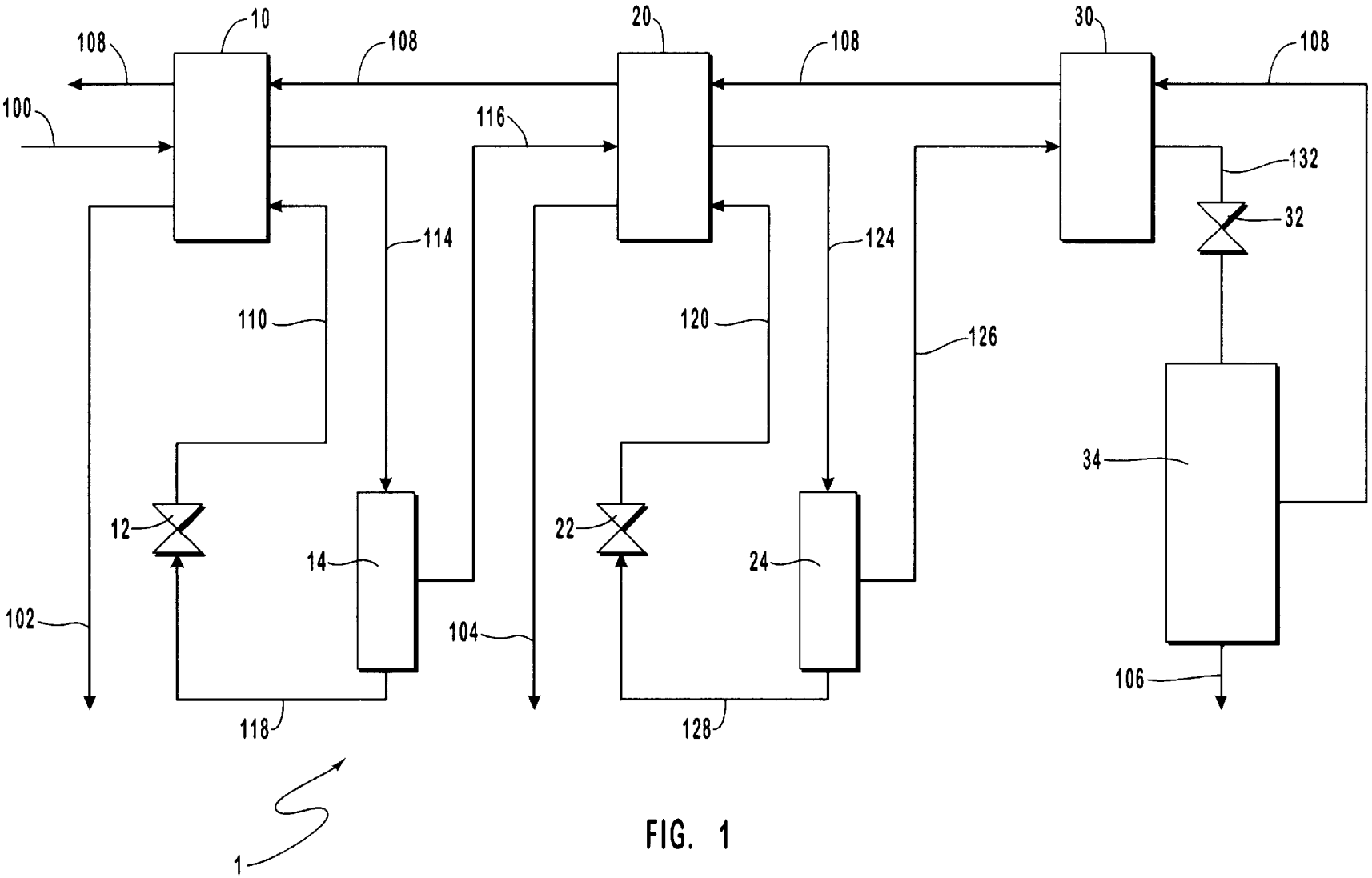
FIG. 1 is a schematic flow diagram which illustrates one possible embodiment of the inventive gas processing system.

Depicted in FIG. 1 is one embodiment of a gas processing system 1 incorporating features of the present invention. Although system 1 can be adapted for use with any type of mixed gas stream, the operation of system 1 will be discussed with regard to the use of natural gas. Natural gas includes methane and other higher hydrocarbons such as propane, butane, pentane, and ethane. In one embodiment, system 1 is designed to substantially remove the higher hydrocarbons from the natural gas so as to produce a liquified natural gas (LNG) which is predominately methane.

Depicted in FIG. 1, a pressurized initial mixed gas stream 100 is introduced into system 1. Mixed gas stream 100 comprises a plurality of mixed component gases, such as found in most natural gas coming from a well head. As discussed below in greater detail, exiting from system 1 is a first component stream 102, a second component stream 104, a final liquid stream 106, and a final gas stream 108.

At any gas pressure, each of the component gases within mixed gas stream 100 have a different condensation point or temperature where the gas condenses to a liquid. As disclosed herein, this principle is used in the separation, cooling, and liquefaction of gas stream 100. While the present disclosed embodiment describes a process with at least three component gases, no limitation exists as to the number of minimum or maximum components or separation steps. Mixed gas stream 100 simply needs a minimum of two gases, and no maximum limit on the number of possible gases exists. Likewise, while typically the individual components will be sequentially and individually removed, this invention contains no such limiting requirement. It is well within the scope of this invention to separate groups of gas components together, although the discussion which follows will refer to the separation of single component streams.

Typically, gas stream 100 is delivered to gas processing system 1 at a pressure greater than 250 psia, preferably greater than 500 psia, and more preferably greater than 1000 psia. These pressures can be obtained naturally from a gas well or obtained by adding energy through the use of one or more compressors. Since a high pressure drop is helpful in the liquefaction process, initial higher pressures are typically preferred.

Some of the factors which influence the required initial pressure of gas stream 100 are the required output pressures and temperatures, the gas mixture composition, and the heat capacities of the different components. Since gas stream 100 is pressurized, it inherently contains cooling potential. With a simple expansion, the entire stream can be cooled. Additionally, once the stream's components are condensed to a liquid phase and separated, that liquid phase stream can also be expanded for cooling.

None of the Figures show, nor does this invention affect, the pretreatment steps which often would precede or accompany a process of separation and liquefaction. The pretreatment steps may be separate steps located either upstream of the cooling cycles to be discussed, or may even be found downstream of one or all of the various cooling cycles. Some of the known means taught in the art and readily available in the marketplace include sorption processes using an aqueous phase containing amines for removal of acid gases and at times mercaptan, simple processes of compression and cooling followed by a two-phase gas-liquid separation for removal of unwanted water, and sorbent beds and regenerable molecular sieves for removal of contaminants such as mercury, water, and acid gases.

Returning to FIG. 1, the first step of the separation, cooling, and liquefaction process comprises passing mixed gas stream 100 through one or more first heat exchangers 10. First heat exchanger 10 lowers the temperature of mixed gas stream 100 below the condensation point of what will be called a first component. This first component is defined as the gas, or gases, having the highest condensation point. For example, in one embodiment the first component may be propane. The effective cooling of first heat exchanger 10 is selectively controlled and depends, in part, on the types of gases to be condensed.

As discussed later in greater detail, the refrigerant for first heat exchanger 10 comes from two cooling streams, a first component stream 110 and final gas stream 108. In alternative embodiments, only one of streams 108 and 110 are necessary for cooling within first heat exchanger 10. Mixed gas stream 100 leaves first heat exchanger 10 as mixed gas stream 114 containing the condensed first component.

It is noted that each of the different process streams undergo changes in their physical characteristics as the streams are heated, cooled, expanded, evaporated, separated, and/or otherwise manipulated within the inventive system. The fact that the name of a stream does not change, but its reference number does, simply indicates that some characteristic of the stream has changed.

It should also be recognized that the present invention is not limited by a type or sequence of heat exchange. First heat exchanger 10 simply must remove sufficient energy or heat from gas stream 100 to facilitate condensation of the first component. This heat removal can be accomplished with any conventional or newly developed heat exchanger using an individual or any combination of the first component stream 110 and final gas stream 108. As needed, the cooling potential of the two cooling streams 108 and 110 can be varied in an almost infinite number of ways.

Mixed gas stream 114 next travels to a gas-liquid separator 14. Such separators come in a variety of different configurations and may or may not be part of heat exchanger 10. Separator 14 separates the condensed first component from the remaining gases. The gas phase, now at least mostly devoid of the first component, exits separator 14 as a diminished mixed gas stream 116. The condensed first component exits separator 14 as a liquid first gas stream 118.

Liquid first component stream 118 is next cooled by passing through an expander 12. As used in the specification and appended claims, the term "expander" is broadly intended to include all apparatus and method steps which can be used to obtain a pressure reduction in either a liquid or gas. By way of example and not by limitation, an expander can include a plate having a hole in it or conventional valves such as the Joule-Thompson valve. Other types of expanders include vortex tubes and turbo expanders. The present invention also appreciates that there are a variety of expanders that are currently being developed or that will be developed in the future and such devices are also encompassed within the term "expander."

Expander 12 produces a pressure drop between liquid first component stream 118 entering expander 12 and first component stream 110 exiting expander 12. As a result of the pressure drop, first component stream 110 expands to produce and adiabatic cooling of stream 110. Depending on the amount of the pressure drop, some or all of stream 110 can be vaporized. This vaporization is a type of evaporization in that the stream goes through a phase change from a liquid to a vapor. To some extent, the greater the pressure drop, the lower the temperature of stream 110, and the higher the extent of cooling or vaporization.

As previously discussed, first component stream 110 is next fed into heat exchanger 10 where it functions as a refrigerant to draw heat from initial mixed gas stream 100, thereby cooling gas stream 100. Since first component stream 110 is functioning as a refrigerant, the amount of pressure drop at expander 12 is dependent on the amount of required cooling for heat exchanger 10. In general, it is preferred that at least a portion of first component stream 110 remain in a liquid state as it enters first heat exchanger 10. The liquid has a greater heat absorption potential since it will absorb energy during evaporization within first heat exchanger 10.

First component stream 110 exits first heat exchanger 10 as first component stream 102. Depending on the pressure and cooling potential of stream 102, stream 102 can be looped back through the system, as discussed later, to produce further cooling. Otherwise, stream 102 can be disposed of, collected, or otherwise transported off site for use consistent with the type of gas.

The disclosed unique removal of first component stream 102 from mixed gas stream 100 produces a variety of benefits. For example, depending on the controlled temperatures of first heat exchanger 10, stream 102 can be removed as a substantially pure discrete gas. That is, where propane is the highest hydrocarbon gas in gas stream 100, the propane can be removed as stream 102 in a substantially pure state for subsequent use or sale. Simultaneously, by drawing off first component stream 118, diminished mixed gas stream 116 has been refined in that it now has a higher concentration of methane.

One of the more significant advantages of the inventive separation process is that it uses a portion of the initial mixed gas stream 100 to continually function as the refrigerant for cooling initial gas stream 100. As a result, the need for an independent cooling cycle, such as a closed refrigeration cycle found in most conventional liquefaction systems, is eliminated. In addition, where the initial pressure of mixed gas stream 100 is sufficiently high, separation and use of the first component stream as the cooling mechanism is accomplished without the addition of external energy, such as through the use of a compressor.

The above process is next repeated for mixed gas stream 116 so as to remove the next component gas. That is, diminished mixed gas stream 116 passes through one or more second heat exchangers 20 and is cooled to a temperature below the highest condensation point of the remaining gas components. As a result, a second component condenses within mixed gas stream 124 leaving second heat exchanger 20. The refrigerant for second heat exchanger 20 is also obtained from two cooling streams, a second component stream 120 and final gas stream 108.

The condensed second component is removed as a liquid from mixed gas stream 124 in a second gas-liquid separator 24. The gas phase, now at least mostly devoid of the second component, exits second separator 24 as a second diminish mixed gas stream 126. The condensed second component exists second separator 24 as a liquid second component stream 128. In turn, second component stream 128 passes through a second expander 22 where it experiences a pressure drop. As a result of the pressure drop, second component stream 120 leaving expander 22 is cooled and, in most embodiments, at least partially vaporized. As discussed above, second component stream 120 passes through second heat exchanger 20 where it functions as a refrigerant for withdrawing heat from mixed gas stream 116. After passing through second heat exchanger 20, the second component stream exits as second component stream 104. As with stream 102, stream 104 can also be cycled back through the system for further cooling or removed for independent use.

It should now be recognized that the process steps of: (1) cooling the mixed gas stream to condense at least one component; (2) separating the condensed liquid component; (3) cooling the separated liquid component by expansion; and (4) using the cooled component stream independently or in conjunction with a final gas stream to cool the incoming gas stream can be repeated as many times as necessary and desired. That is, the above process can be repeated to independently draw off as many discrete components as desired. In this fashion, discrete components gases can be drawn off independently in a substantially pure form. Alternatively, the component gases can be drawn off in desired groups of gases.

In this example, where no further components are to be drawn off, the second diminished mixed gas stream 126 is further cooled by passing through a third heat exchanger 30 to create a final mixed gas stream 132. The refrigerant for third heat exchanger 30 comprises final gas stream 108. Final mixed gas stream 132 can, depending on the desired final product, be a single purified component which has the lowest condensation point of any of the components in original gas stream 100, or be a combination of the gas components.

In one embodiment, final mixed gas stream 132 is substantially pure methane in a gas phase. To liquify gas stream 132, gas stream 132 is passed through an expander 32 to produce a pressure drop. The pressure drop cools gas stream 132 causing at least a portion of gas stream 132 to liquify as it travels into a final gas-liquid separator 34. The liquefied gas exits separator as final liquid stream 106 while the gas or vapor is within separator 34 exits as final gas stream 108. As previously discussed, final gas stream 108 passes back through each of heat exchangers 10, 20 and 30 where it functions as a refrigerant. Final gas stream 108 can then be recycled into the system, transported off site, or connected with municipal gas line for conventional home or business use. In one embodiment, final gas stream 108 has a pressure less than about 100 psia and more preferably less than about 50 psia.

As set forth above, the operation of liquefaction system 1 produce a liquid final product stream 106 can be accomplished without the addition energy, such as the use of a compressor. Operation of the system in this manner, however, typically requires that the input pressure of gas stream 100 be greater than about 500 psia and preferably greater than about 1000 psia. In order to obtain a high percentage of liquid methane, it is preferred to have an input pressure of 1500 psia and more preferably greater than about 2000 psia. Where the well head pressures are insufficient, the present invention envisions that a compressor can be used to increase the pressure of initial mixed gas stream 100.

Depicted in FIGS. 2–7 are alternative embodiments of system 1. The different embodiments are not intended to be limiting but rather examples intending to demonstrate the flexibility of the present invention.

Figure 2:
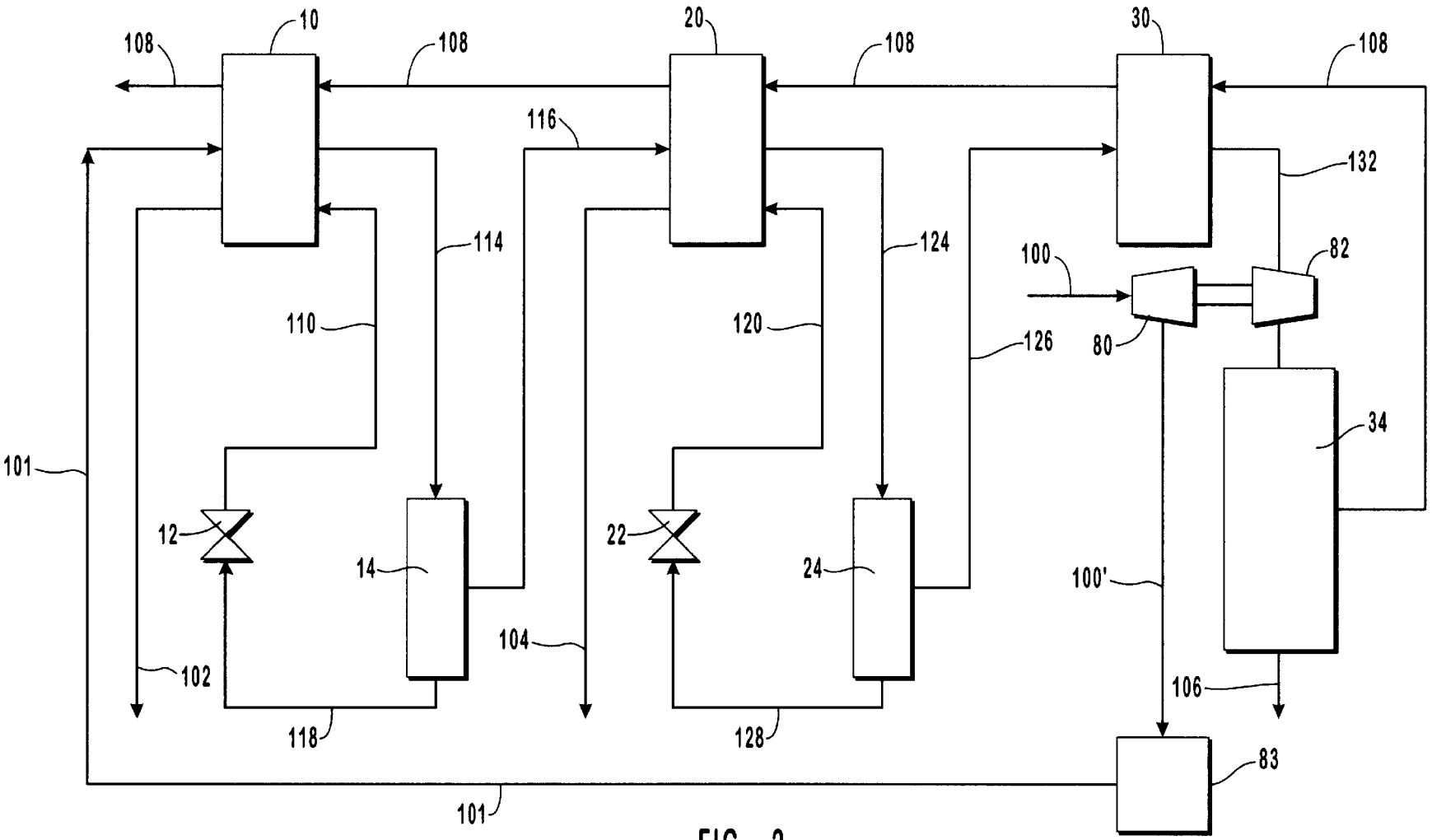
FIG. 2 is a schematic flow diagram of the system shown in FIG. 1 incorporating a turbo expander operating a compressor.

Depicted in FIG. 2, initial gas stream 100 is initially passed through a compressor 80 to increase the pressure thereat prior to entering the system. To minimize the energy requirement of compressor 80, expander 32 of FIG. 1 is comprised of a turbo expander 82. Turbo expander 82 facilitates expansion of mixed gas stream 132 while simultaneously rotating a turbine. The turbine can be used to generate mechanical or electrical energy which runs compressor 80. Accordingly, by using compressor 80 which is run by turbo expander 82, the initial gas pressure can be increased without the required addition of an external energy source. In alternative embodiments, additional energy sources, such as an external motor, can also be used to independently drive or assist in driving compressor 80.

Although not required, in one embodiment compressed gas stream 100' leaving compressor 80 is passed through a preliminary heat exchanger 83. Heat exchanger 83 can comprise a variety of configurations which depend on the surrounding environment. For example, heat exchanger 83 can be a conventional ambient air cooled heat exchanger or, were available, different water sources such as a river or lake can be used as the cooling element of heat exchanger 83. The preliminary cooled gas stream 101 travels from heat exchanger 83 to first heat exchanger 10 where the process as discussed with regard to FIG. 1 is performed.

Of course, compressor 80 can be used for compressing the gas stream at any point along the system. Furthermore, compressor 80 can be replaced with a refrigeration system which is also run by turbo expander 82. The refrigeration system can be used for further cooling the gas stream at any point along the system.

Figure 3:
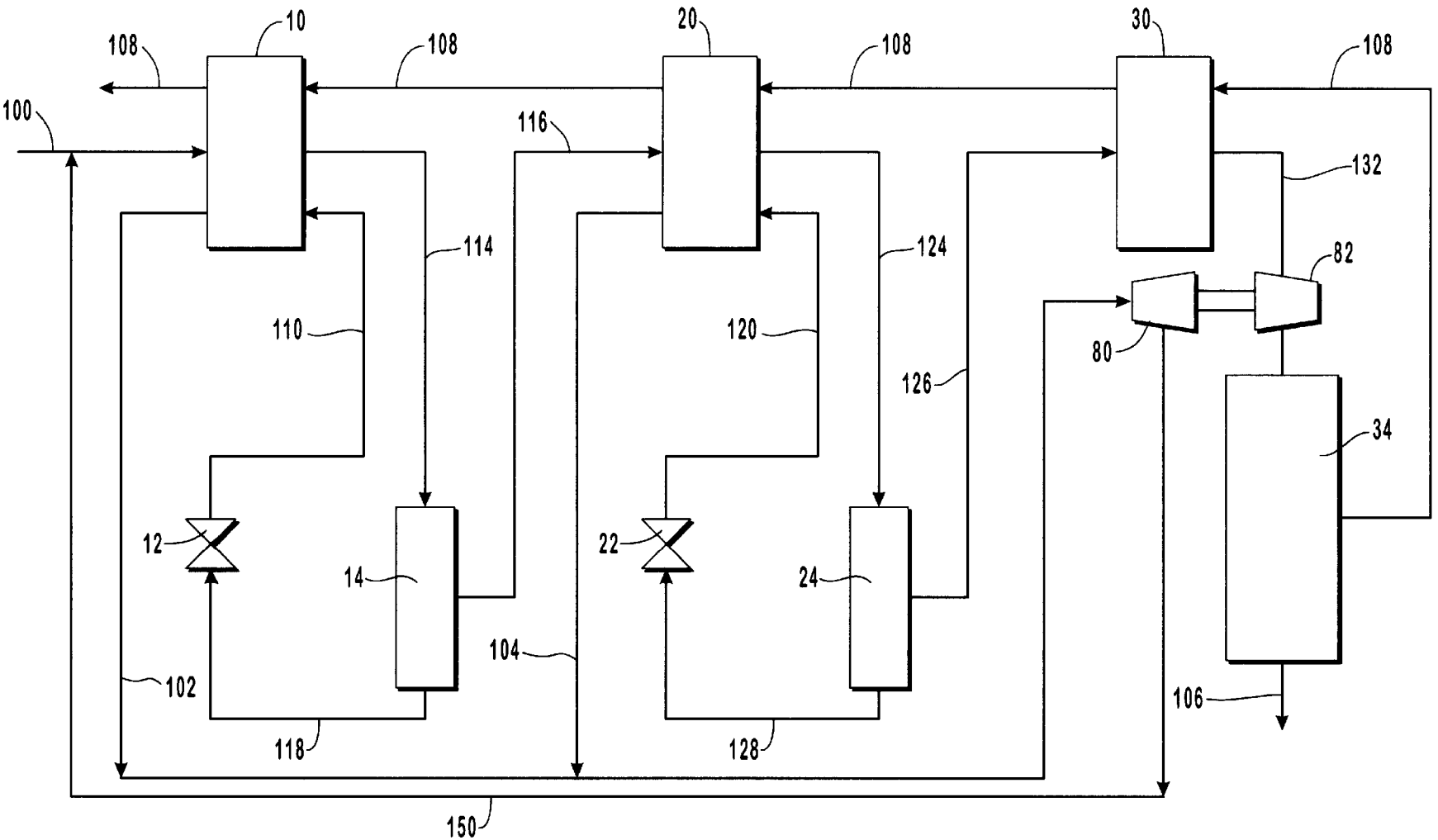
FIGS. 3–6 are schematic flow diagrams of the system shown in FIG. 2 wherein the compressor is compressing alternative gas streams.

In the embodiment depicted in FIG. 3, first component stream 102 and second component stream 104 are fed into compressor 80 which is again operated by turbo expander 82. The resulting compressed gas stream 150 is fed back into initial mixed gas stream 100, thereby recycling the various component streams for use as refrigerants. Furthermore, depending on the temperature of streams 102 and 104, feeding compressed gas stream 150 into stream 100 can also lower the temperature of stream 100.

Figure 4:
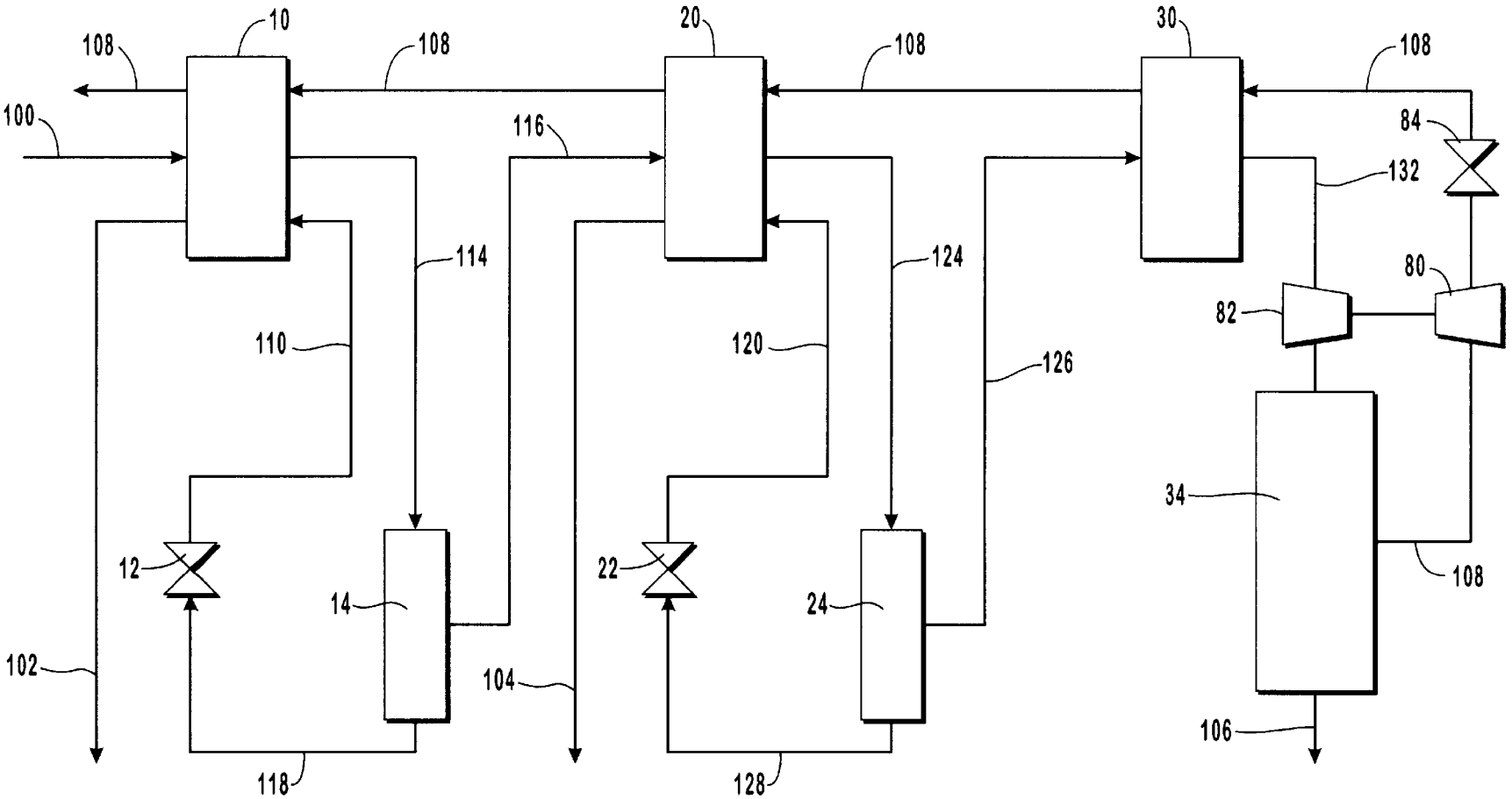

In another embodiment as depicted in FIG. 4, compressor 80 is configured to compress final gas stream 108 leaving gas-liquid separator 34. Compressor 80 is again driven by turbo expander 82 having final mixed gas stream 132 passing therethrough. Final gas stream 108 leaving compressor 80 is cooled by passing through an expander 84. Cooled gas stream 108 then passes through each of heat exchangers 10, 20 and 30 in series, as previously discusses with regard to FIG. 1, to facilitate the cooling of the mixed gas streams passing therethrough.

Figure 5:
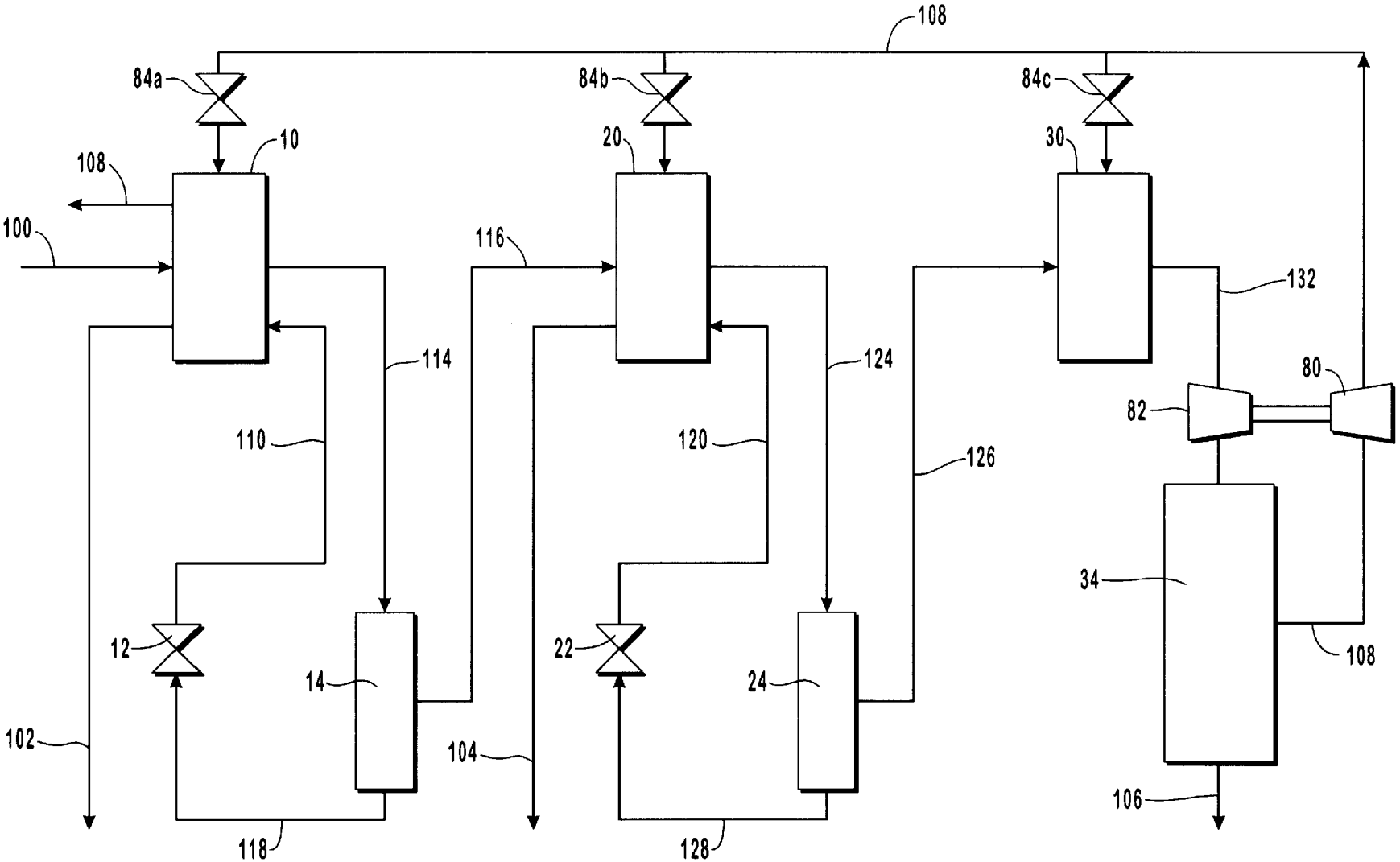

In a similar embodiment depicted in FIG. 5, final gas stream 108 is again compressed by compressor 80 driven by turbo expander 82. Rather than using a single expander 84, however, separate expanders 84*a*, 84*b* and 84*c* are coupled with heat exchangers 10, 20, and 30, respectively. Final gas stream 108 is connected to each of expanders 84*a*, 84*b* and 84*c* in parallel. As a result, the cooling of final gas stream 108 by expanders 84*a*, 84*b* and 84*c* is equally effective for each of heat exchangers 10, 20, and 30.

Figure 6:
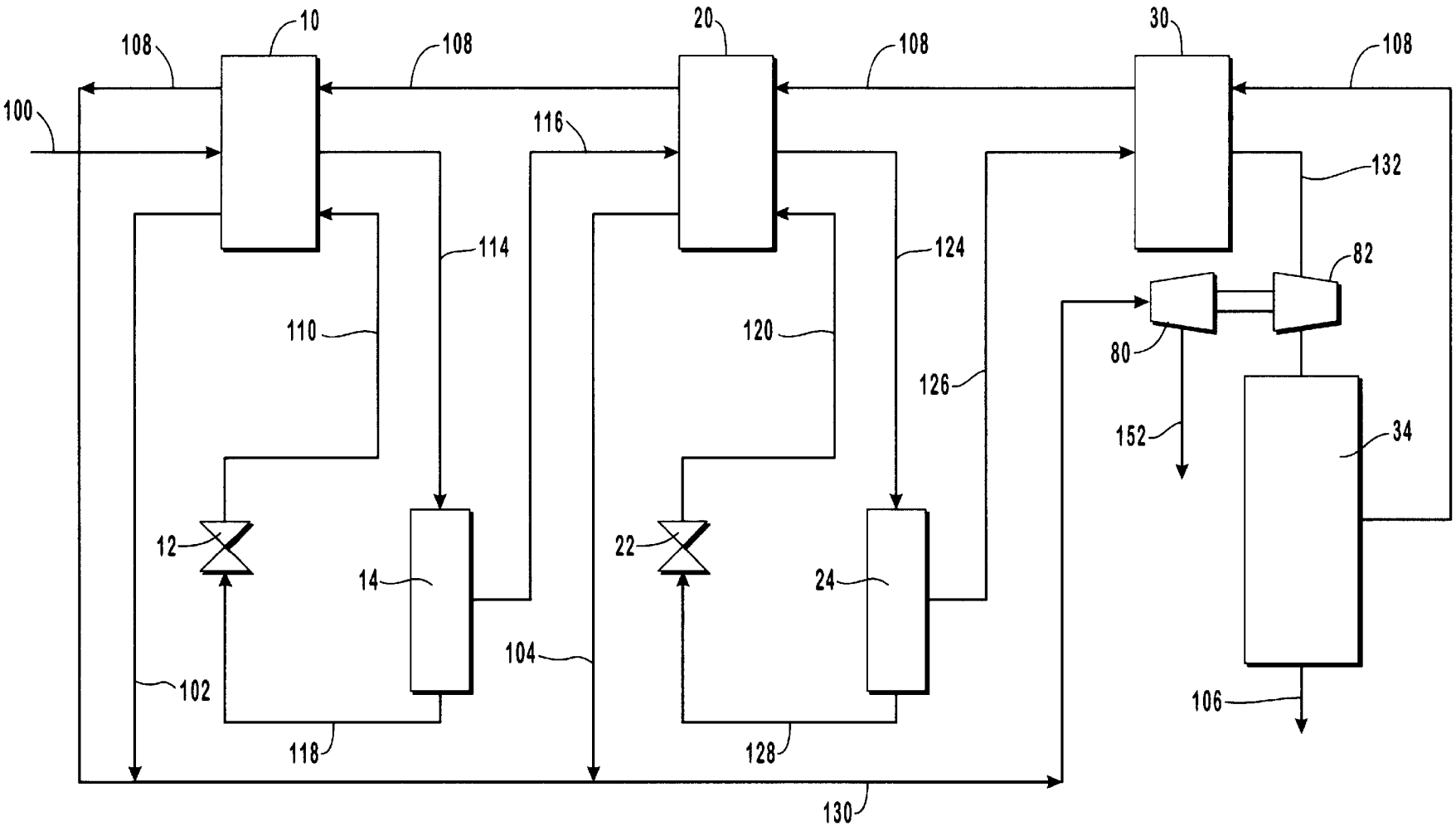

Final gas stream 108, as previously discussed with FIG. 1, is typically connected to an output line for feeding residential and commercial gas needs. Connecting to such a line, however, requires that the gas have a minimal pressure which is typically greater than about 40 psia. As depicted in FIG. 6, where the pressure of final gas stream 108 has dropped below the minimal required pressure, final gas stream 108 can be fed through compressor 80 operated by turbo expander 82. The departing gas stream 152 would then have the required minimal pressure for connection to the output line. Depending on the quality of gas required, first component stream 102 and second component stream 104 can be feed into final gas stream 108.

Figure 7:
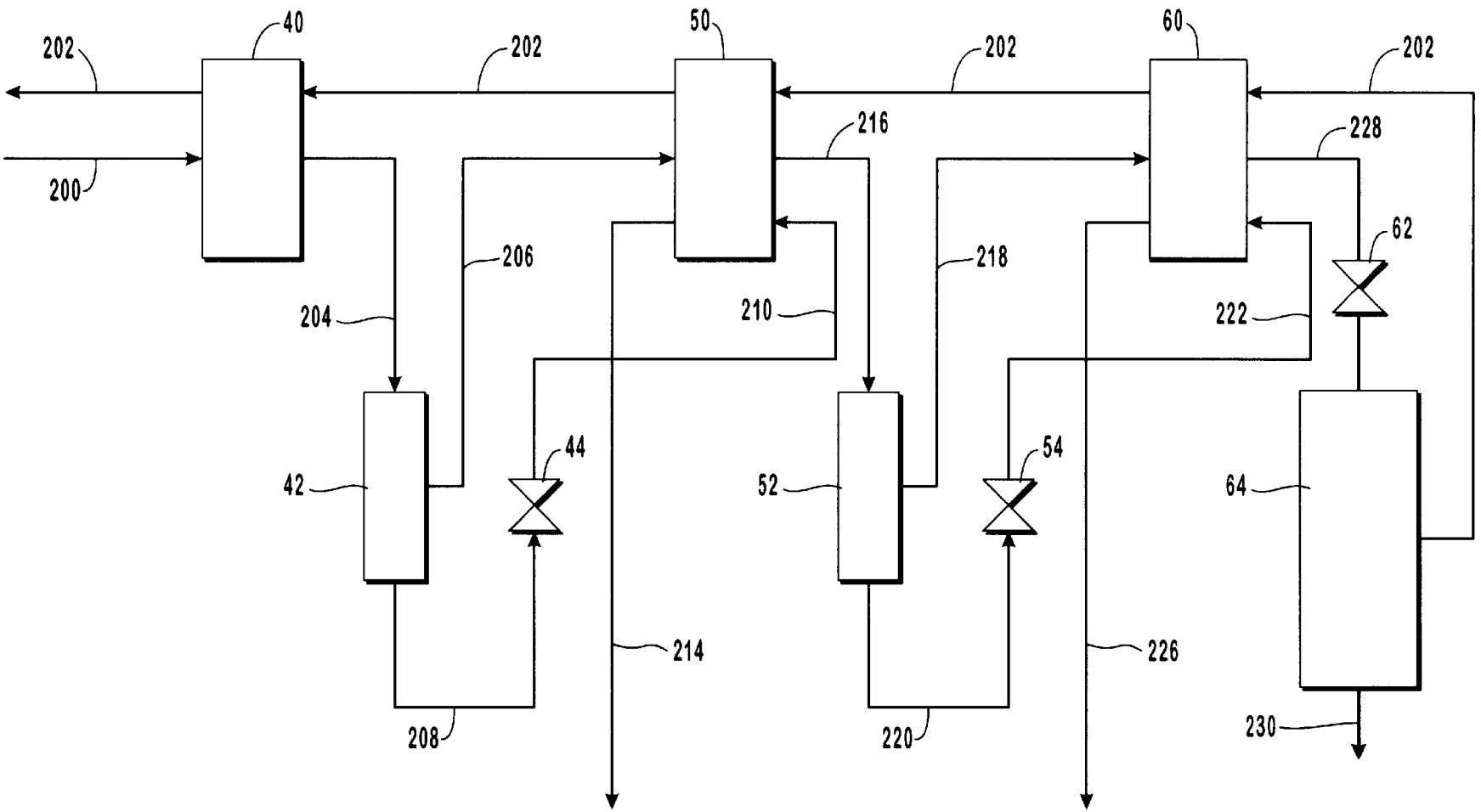
FIG. 7 is a schematic flow diagram of an alternative configuration of the system shown in FIG. 1.

In yet another embodiment as depicted in FIG. 7, a pressurized mixed gas stream 200 is cooled in a first heat exchanger 40 with a final gas stream 202. Just as in FIG. 1, first heat exchanger 40 causes the condensation of a first component in mixed gas stream 200. The condensed first component is separated from the remaining gases of the resulting mixed gas stream 204 in a liquid-gas separator 42. The gas phase components exit separator 42 as a diminished mixed gas stream 206. The condensed first component exits separator 42 as a liquid first component stream 208. The liquid first component stream 208 is cooled by passing through a first expander 44 to produce a cooled first component stream 210.

The difference between the present embodiment and the embodiment described in FIG. 1, is that instead of using first component stream 210 to cool the pressurized mixed gas stream 200 in first heat exchanger 40, first component stream 210 is used as a refrigerant in the heat exchanger of the next separation cycle. In this specific embodiment, first component stream 210 cools diminished mixed gas stream 206 as it passes through a second heat exchanger 50. Additional cooling can also be obtained in second heat exchanger 50 by using final gas stream 202. First component stream 210 exits second heat exchangers 50 as first component stream 214. The diminished mixed gas stream 206 is cooled in second heat exchanger 50, thereby creating a mixed gas stream 216 with a condensed second component.

Next, mixed gas stream 216 follows the same process steps as described above for mixed gas stream 204. The process continues with the separation of the condensed second component from the remaining gas phase components in a second gas-liquid separator 52. The remaining gas phase components exit the second separation 52 as a second diminished mixed gas stream 218. The condensed second component exits the second separator 52 as a liquid second component stream 220. Liquid second component stream 220 passes through a second expander 54 to create a cooled second component stream 222.

Second component stream 222 is then used to cool second diminished mixed gas stream 218 in a third heat exchanger 60. Additional cooling can also be accomplished in third heat exchanger 60 by using final gas stream 202. Second component stream 222 then exits third heat exchanger 60 as a second component stream 226. Second diminished mixed gas stream 218 is cooled in third heat exchanger 60 creating a final mixed gas stream 228. This final mixed gas stream 228 is then expanded through an expander 62 to produce a cooled, low pressure liquid and gas product. The liquid and gas product is separated in a final gas-liquid separator 64. The liquid exits the process as a final liquid stream 230, and the gas phase exiting the final separator 64 as the final gas stream 202. Final gas stream 202 travels back through heat exchangers 40, 50, and 60 as previously discussed.

Figure 8:
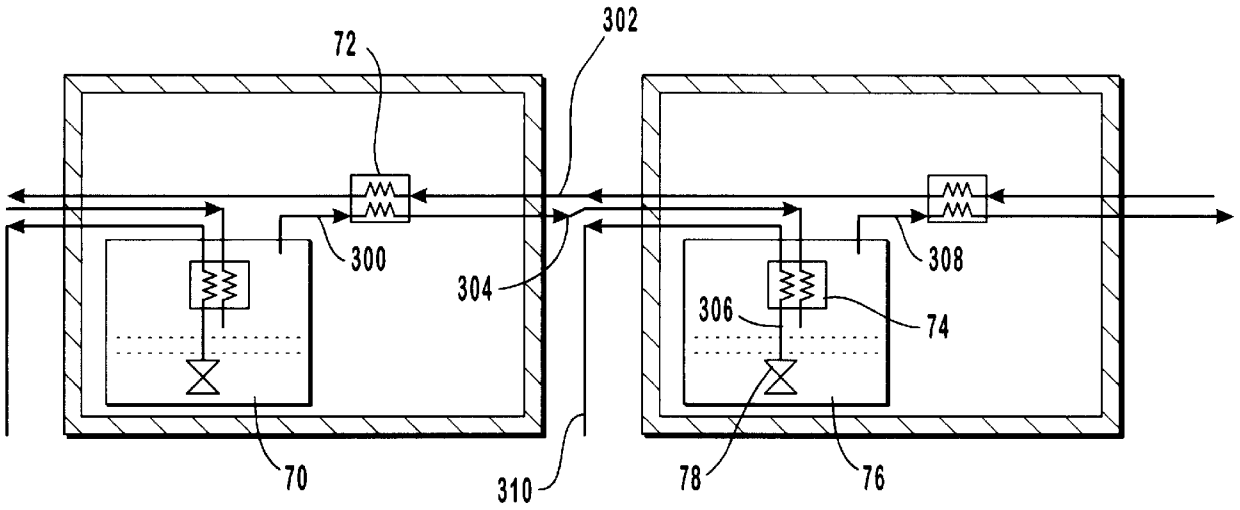
FIG. 8 is a schematic flow diagram of one example of one of the cycles shown in FIG. 1.

FIG. 8 shows a more detailed flow diagram for a single process cycle of cooling a mixed gas stream to produce condensed component; separation of the condensed component from the remaining gas; expansion of liquid component, and using the cooled, expanded component for further cooling. It is to be understood that this recital of equipment and methods is not to be considered limiting, but is presented to illustrate and set forth one example.

A diminished mixed gas stream 300 exits a first gas-liquid separator 70 and is cooled by passing through a first heat exchanger 72. A final gas stream 302 functions as the refrigerant for first heat exchanger 72. The now cooled diminished mixed gas stream 304 is further cooled in a second heat exchanger 74. A cooled component stream 306 functions as the refrigerant for second heat exchanger 74. The first and second heat exchangers 72 and 74 of FIG. 8 correspond to heat exchanger 10 of FIG. 1. Second heat exchanger 74 cools diminished mixed gas stream 304 to below the condensation point of the stream's highest component, thereby creating a gas and liquid mixture which is separated in a second gas-liquid separator 76. The gas phase then exits second separator 76 to enter into the next cycle. The liquid condensed component is expanded through a Joule-Thompson expansion valve 78 which not only evaporates the liquid, but further cools the stream with expansion creating the cooled component stream 306. After component stream 306 cools the diminished mixed gas stream 304 in second heat exchanger 74, it exits the process as a component stream 310.

The above described systems depicted in FIGS. 1–8 and variations thereon, can be used in a variety of different environments and configurations to perform different functions. For example, as discussed above, one of the basic operations of the inventive system is in the production of liquefied natural gas (LNG). LNG is becoming increasing more important as an alternative fuel for running automobiles and other types of motorized equipment or machines. To produce the required need for LNG, the inventive system can be selectively designed and manufactured to accommodate small, medium, and large capacities.

For example, one preferred application for the inventive system is in the liquefaction of natural gas received from conventional transport pipelines. Inlet natural gas streams typically have pipeline pressures from between about 500 psi to about 900 psi and the product liquid natural gas streams may have flow volumes between about 1,000 gallons/day to about 10,000 gallons/day. The inventive system can also be used in peak demand storage. In this embodiment, pipeline gas at between about 500 psi to about 900 psi is liquefied and put in large tanks for use at peak demand times. The product liquid natural gas stream volumes, however, are very large, typically ranging from about 70,000 gallons/day to about 100,000 gallons/day. Similar to peak demand storage is export storage. In export storage, large quantities of LNG are produced and stored prior to over seas shipping. In this embodiment even larger volumes of liquid natural gas is produced, typically between about 1 million gallons/day to about 3 million gallons/day.

Whereas most natural gas processing facilities are only economical, due to their design parameters, for manufacturing on a large scale, the inventive system is easily and effectively manufactured on a small scale. This is because the inventive system is a relatively simple continuous flow process which requires minimal, and often no, external energy sources such as independently operated refrigeration systems or compressors. Rather, the inventive system can often be run solely on the well head or gas line pressure. As a result, the inventive system can be manufactured to produce LNG at small factories, refueling stations, distribution points, and other desired locations. The inventive systems can also be designed to produce on demand so that large storage tanks are not required.

A further benefit of the self powered property of the system is that it is well suited for operation in remote locations. For example, the system can be positioned at individual well heads for processing the gas. This is beneficial in that the system can use the high well head pressure, often above 2,000 psi, to facility operation of the system. Simultaneously, the system can remove undesired impurities from the natural gas as discrete components while dropping the pressure of the resulting purified gas, typically below 1,000 psi, for feeding into a conventional transport pipeline. In one embodiment, rather than having final mixed stream 132 in FIG. 1 pass through expander 33 for liquefaction, final mixed stream 132 can be fed directly into a transport pipeline. Alternatively, final gas stream 108 can be connected to the transport pipeline.

Figure 9:
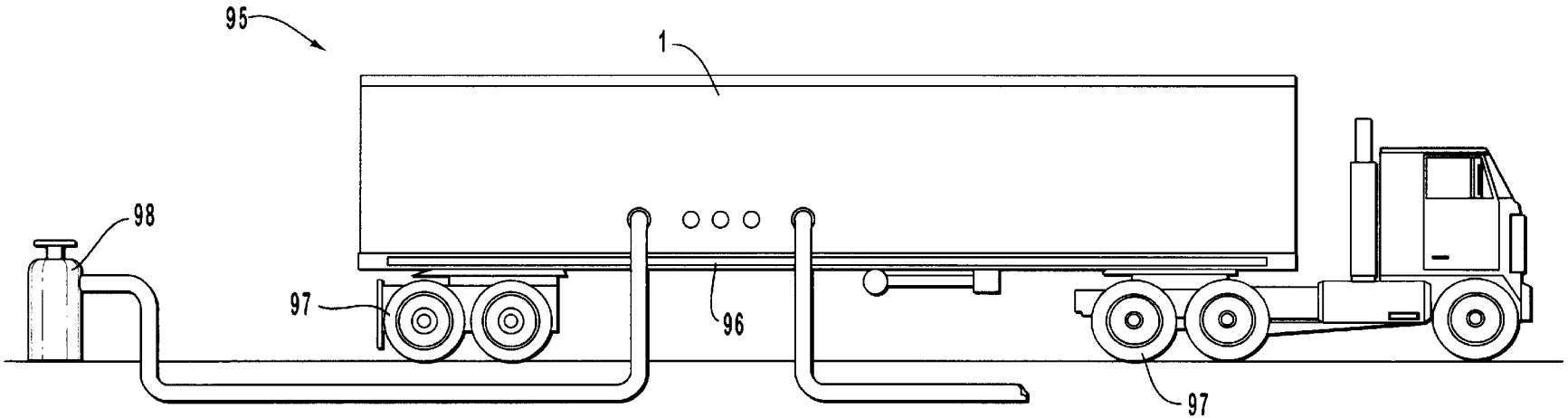
FIG. 9 is a perspective view of a mobile unit incorporating the system shown in FIG. 1.

As depicted in FIG. 9, the present invention also envisions a mobile unit 95 which can be easily transported to different locations for use as required. Mobile unit 95 includes system 1 being mounted on a movable trailer 96 having wheels 97. Alternatively unit 95 may not have wheels, but is just movable or transportable. Mobile unit 95 can be used at virtually any location. For example, mobile unit 95 can be positioned in a gas field for direct coupling with a gas well 98.

Figure 10:
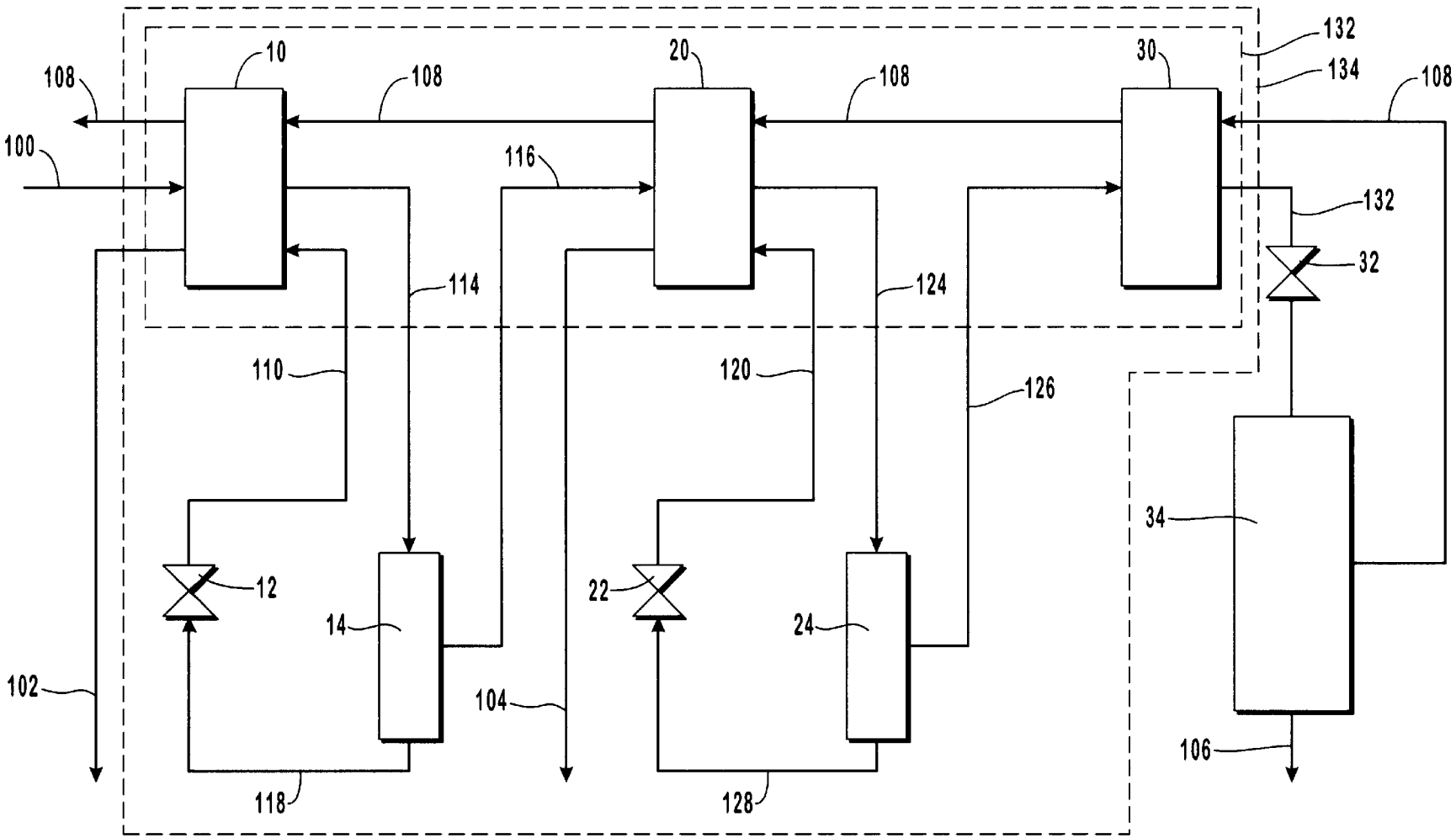
FIG. 10 is a schematic flow diagram of the system shown in FIG. 1 incorporating vacuum chambers.

An additional benefit of producing small facilities, such as mobile unit 95, is the ability to better insulate the system. For example, depicted in FIG. 10, each heat exchanger 10, 20, and 30 is enclosed in a single vacuum chamber identified by dashed line 322. Alternatively, a vacuum chamber identified by dashed line 324 can also enclose expanders 12 and 22 along with gas-liquid separators 14 and 24. In alternative embodiments, vacuum chambers can be designed to enclose any desired elements. The incorporation of such vacuum chambers is practically impossible in large systems but produces substantial savings in the inventive small systems.

An additional use for the inventive system is in gas purification. For example, many productive gas wells are found that have high concentrations of unwanted gases such as nitrogen. Rather than transporting the gas to a large processing plant for cleaning, it is often more economical to simply cap the well. By using the present invention, however, small mobile systems can be positioned directly at the well head. By then adjusting the system to accommodate the specific gas, the various condensation cycles can be used to draw off the unwanted gas or gasses which are then vented or otherwise disposed. The remaining purified gasses can then be transported for use. Of course, in the alternative, the desired gases can be selectively drawn off in various condensations cycles while the final remaining gas is left as the unwanted product.

In yet another alternative use, the inventive system can be used in capturing vapor loss in large storage facilities or tanks. That is, LNG is often stored in large tanks for use at peak demand or for overseas shipping on tankers. As the LNG warms within the stored tanks, a portion of the gas vaporizes. To prevent failure of the tank, the gas must slowly be vented so as not to exceed critical pressure limits of the storage tank. Venting the natural gas to the atmosphere, however, raises some safety and environmental concerns. Furthermore, it results in a loss of gas.

Figure 11:
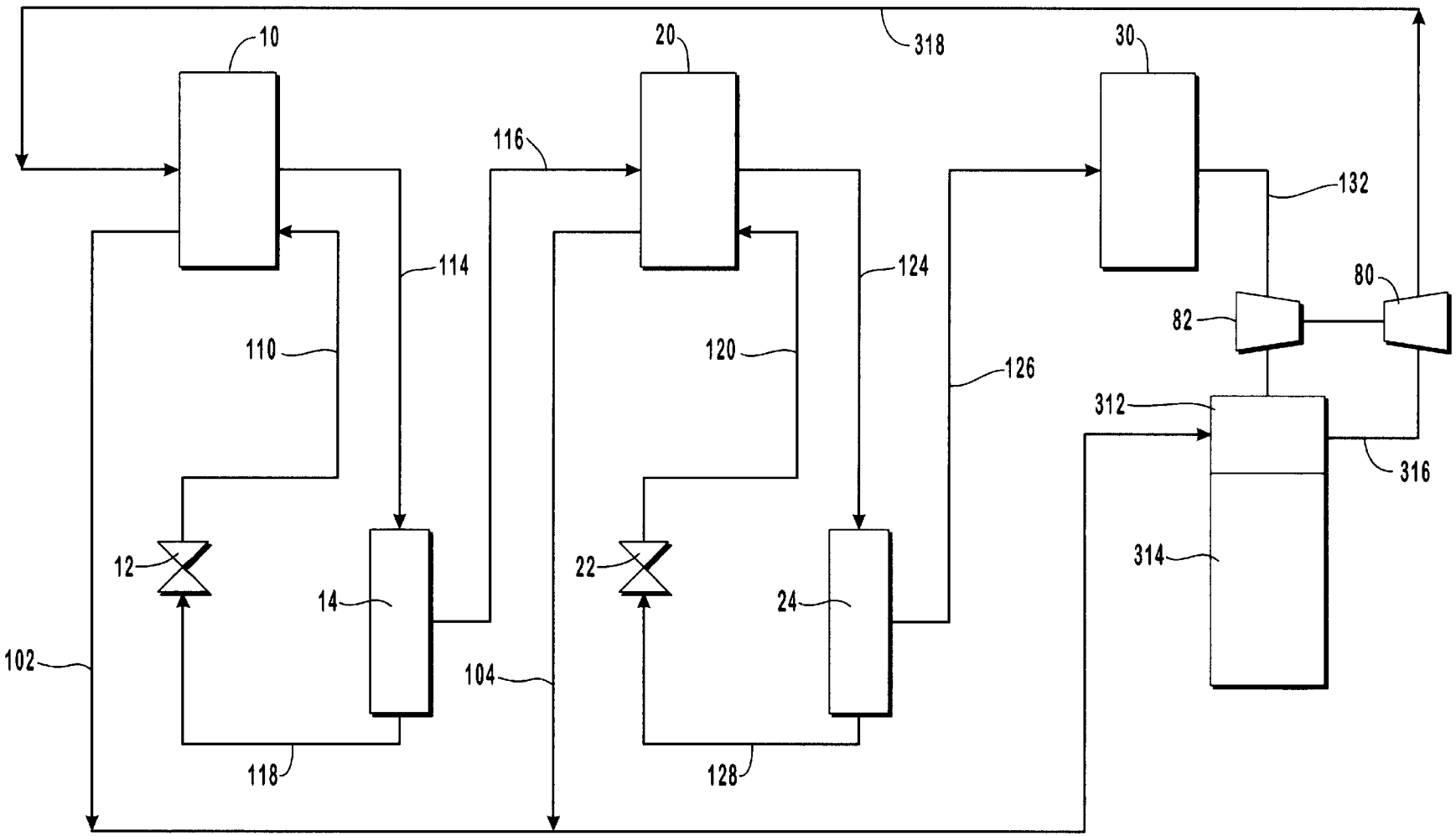
FIG. 11 is a schematic flow diagram of the system shown in FIG. 1 modified to recondense vapor from a storage tank.

Depicted in FIG. 11 is a large storage tank 312 holding LNG 314. When pressure within tank 312 exceeds a desired limit, a vaporized gas stream 316 leaves tank 312 and is compressed by compressor 80. In one embodiment, it is envisioned that the process can be run by the pressure build-up within tank 312. In this embodiment, it may be possible to use turbo expander 82 with the returning gas to run compressor 80. In alternative embodiments, an outside generator or other electrical source is used to run compressor 80. Compressed gas stream 318 exits compressor 80 and returns to heat exchanger 10 where the cooling process begins substantially as described with regard to FIG. 1. One of the differences, however, is that the component gas streams 102 and 104 are simply returned to tank 312.

We claim:

1. A compressorless process for separating and cooling a pressurized mixed gas stream having at least two components, wherein the latent energy of each individual, separated component is captured by the process to further cool the pressurized mixed gas stream, the process comprising the steps of:

a. cooling the mixed gas stream to a temperature below a condensation point of a first component within the mixed gas stream;

b. separating the condensed first component from the mixed gas stream, thereby creating a liquid first component stream;

c. cooling the liquid first component stream by expansion; and d. using the expanded first component stream to cool the mixed gas stream.

2. A process as described in claim 1, wherein the expanded first component stream is used to cool the mixed gas stream prior to separating the condensed first component.

3. A process as described in claim 1, wherein the expanded first component stream is used to cool the mixed gas stream after separating the condensed first component.

4. A process as described in claim 1, wherein the process further comprises the steps of:

a. expanding the mixed gas stream after separating the condensed first component to create a liquid phase and a gas phase;

b. separating the liquid phase from the gas phase; and c. using the gas phase to cool the mixed gas stream.

5. A process for separating and cooling one or more components of a pressurized mixed gas stream, the process comprising the steps of:

a. cooling the pressurized mixed gas stream in a first heat exchanger to condense a first component thereof;

b. separating the condensed first component from the mixed gas stream, thereby creating a first component stream in a liquid state;

c. passing the first component stream through a first expander so as to cool the first component stream; and d. using the expanded first component stream to cool the mixed gas stream.

6. A process as described in claim 5, wherein the step of using the expanded first component stream to cool the mixed gas stream comprises feeding the expanded first component stream into the first heat exchanger.

7. A process as recited in claim 5, wherein the step of cooling the mixed gas stream comprises passing the mixed gas stream through a plurality of heat exchangers.

8. A process as recited in claim 5, further comprising the steps of:

a. cooling the mixed gas stream after separating the condensed first component therefrom in a second heat exchanger to condense a second component thereof;

b. separating the condensed second component from the mixed gas stream, thereby creating a second component stream in a liquid state;

c. passing the second component stream through a second expander so as to cool the second component stream; and d. using the expanded second component stream to cool the mixed gas stream.

9. A process as described in claim 8, wherein the step of using the expanded first component stream to cool the mixed gas stream comprises feeding the expanded first component stream into the second heat exchanger.

10. A process as described in claim 5, further comprising the steps of:

a. expanding the mixed gas stream after separating the condensed first component therefrom to create a liquid phase and a gas phase; and b. separating the liquid phase from the gas phase.

11. A process as described in claim 10, further comprising the step of feeding the gas phase into the first heat exchanger to cool the mixed gas stream.

12. A process as described in claim 10, wherein the step of expanding the mixed gas stream after separating the condensed first component comprises the mixed gas stream being substantially methane.

13. A process as described in claim 10, wherein the step of expanding the mixed gas stream after separating the condensed first component comprises passing the mixed gas stream though a turbo expander.

14. A process as described in claim 13, further comprising the step of passing the mixed stream gas through a compressor prior to cooling the pressurized mixed gas stream in the first heat exchanger, the compressor being at least partially energized by the turbo expander.

15. A process as described in claim 13, further comprising the steps of:

a. passing the first component stream through a compressor, the compressor being at least partially energized by the turbo expander; and b. feeding the compressed first component stream back into the mixed gas stream.

16. A process as described in claim 13, further comprising the step of passing the gas phase through a compressor, the compressor being at least partially energized by the turbo expander.

17. A process as described in claim 16, further comprising the steps of:

a. expanding the compressed gas phase; and b. feeding the expanded gas phase to the first heat exchanger so as to cool the mixed gas stream.

18. A process for separating one or more components from natural gas comprising:

a. feeding a natural gas stream from a gas well to a heat exchanger solely under the natural gas pressure produced by the gas well, the heat exchanger cooling the natural gas so as to condense a first component thereof;

b. separating the condensed first component from the natural gas stream, thereby creating a first component stream in a liquid state;

c. passing the first component stream through an expander so as to cool the first component stream; and d. using the expanded first component stream to cool the natural gas stream.

19. A process for liquefying gas comprising:

a. feeding a gas stream through a heat exchanger so as to cool the gas stream;

b. passing the cooled gas stream through a turbo expander so as to produce energy and to convert the gas stream into a liquid phase and a vapor phase; and c. operating a compressor from the energy produced at least in part by the turbo expander, the compressor compressing the gas stream prior to feeding into the heat exchanger.

20. A process for liquefying gas comprising:

a. feeding a gas stream through a heat exchanger so as to cool the gas stream;

b. passing the cooled gas stream through a turbo expander so as to produce energy and to convert the gas stream into a liquid phase and a vapor phase;

c. compressing the vapor phase produced by the turbo expander in a compressor, the compressor being at least partially operated from the energy produced by the turbo expander;

d. cooling the compressed vapor phase; and e. passing the cooled vapor phase through heat exchanger so as to cool the gas stream passing therethrough.

21. A process for separating and cooling components of a pressurized mixed gas stream comprising the steps of:

a. cooling a pressurized mixed gas stream comprising a first component, a second component, and a third component, the mixed gas stream being sufficiently cooled to condense the first component;

b. separating the condensed first component from the mixed gas stream, thereby creating a first component stream in a liquid state;

c. cooling the first component stream by way of expansion;

d. using the expanded first component stream to cool the mixed gas stream;

e. further cooling the mixed gas stream after the first component is separated therefrom so as to condense the second component;

f. separating the condensed second component from the mixed gas stream, thereby creating a second component stream in a liquid state;

g. cooling the second component stream by way of expansion; and h. using the expanded second component stream to cool the mixed gas stream.

22. A process as described in claim 21, wherein the step of using the expanded first component stream to cool the mixed gas stream comprises heat exchanging the expanded first component stream with the mixed gas stream to facilitate condensing of the first component.

23. A process as described in claim 21, wherein the process further comprises the steps of:

a. passing the mixed gas stream after the second component is removed therefrom through a turbo expander, thereby generating energy and converting the mixed gas stream into a liquid phase and a gas phase; and b. using the gas phase to cool the mixed gas stream prior to passing through the turbo expander.

24. A process as described in claim 23, further comprising compressing the mixed gas stream in a compressor prior to condensing the first component, the compressor being at least partially energized by the energy from the turbo expander.

25. A process as described in claim 24, further comprising passing the compressed gas stream from the compressor through an ambient heat exchanger to further cool the compressed gas stream prior to condensing the first component.

26. A gas processing system, comprising:

a. a first heat exchanger configured to receive a mixed gas stream having a plurality of components;

b. a first gas-liquid separator fluid coupled with the first heat exchanger, the first gas-liquid separator having a liquid stream outlet;

c. a first expander fluid coupled with the liquid stream outlet of the first gas-liquid separator, the first expander also being fluid coupled with the first heat exchanger so as to facilitate cooling of the mixed gas stream when the mixed gas stream flows through the first heat exchanger;

d. a final heat exchanger fluid coupled to the gas stream outlet of the first gas-liquid separator;

e. a final expander fluid coupled with the second heat exchanger down stream thereof; and f. a final gas-liquid separator fluid coupled with the second expander down stream thereof.

27. A gas processing system as recited in claim 26, wherein the final expander comprises a turbo expander.

28. A gas processing system as recited in claim 26, wherein the final expander comprises a vortex tube.

29. A mobile gas processing system, comprising:

a. a trailer having a frame with wheels mounted thereon;

b. a mixed gas processing system mounted on the trailer, the processing system comprising:

(i) a first heat exchanger configured to receive the mixed gas stream;

(ii) a first gas-liquid separator fluid coupled with the first heat exchanger, the first gas-liquid separator having a liquid stream outlet and a gas stream outlet; and (iii) a first expander fluid coupled with the liquid stream outlet of the first gas-liquid separator, the first expander also being fluid coupled with the first heat exchanger so as to facilitate cooling of the mixed gas stream when the mixed gas stream flows through the first heat exchanger;

c. a second heat exchanger fluid coupled with the gas stream outlet of the first gas-liquid separator;

d. a second gas-liquid separator fluid coupled with the second heat exchanger, the first gas-liquid separator having a liquid stream outlet and a gas stream outlet; and e. a second expander fluid coupled with the liquid stream outlet of the second gas-liquid separator, the second expander also being fluid coupled with the second heat exchanger so as to facilitate cooling of the mixed gas stream when the mixed gas stream flows through the second heat exchanger.

30. A mobile gas processing system as recited in claim 29, wherein the first heat exchanger and the second heat exchanger are both enclosed within a single vacuum chamber.

* * * * *